United States Patent [19]

Silinsky

[11] Patent Number: 4,460,898

[45] Date of Patent: Jul. 17, 1984

[54] FOUR ELEMENT ANTENNA TURNSTILE TRACKING SYSTEM

[75] Inventor: Robert E. Silinsky, Lakewood, Calif.

[73] Assignee: Hughes Aircraft Company, El Segundo, Calif.

[21] Appl. No.: 332,984

[22] Filed: Dec. 21, 1981

[51] Int. Cl.[3] ..... H01Q 25/04

[52] U.S. Cl. ..... 343/777; 343/16 M

[58] Field of Search ..... 343/777, 786, 100 PE, 343/16 M, 776, 778, 779

[56] References Cited

U.S. PATENT DOCUMENTS 2,952,014 9/1960 Caldwell, Jr. ..... 343/777

4,052,724 10/1977 Takeichi et al. ..... 343/786

*Primary Examiner*—Eli Lieberman

*Assistant Examiner*—Michael C. Wimer

*Attorney, Agent, or Firm*—Thomas A. Runk; A. W. Karambelas

[57] ABSTRACT

A four element antenna turnstile tracking system which outputs an azimuth error signal, an elevation error signal and an independent sum signal. Three tracking antennas are disposed triangularly at the vertices of a triangle and the sum antenna is disposed in a predetermined relationship to the tracking antennas. The three tracking antennas are symmetrically connected to a unique four port turnstile type junction which generates an elliptical wave in accordance with the difference in signals from the three tracking antennas. An orthogonal mode transducer outputs the orthogonal components of this elliptical wave, these components being the azimuth error and the elevation error signals.

9 Claims, 4 Drawing Figures

FOUR ELEMENT ANTENNA TURNSTILE TRACKING SYSTEM

BACKGROUND OF THE INVENTION

This invention relates to the field of antennas and more particularly to an antenna system which generates signals usable to determine the position of an object which emits or reflects electromagnetic energy.

Object detection and location systems such as precision radar systems used in ground fire control systems, aircraft fire control systems, shipboard fire control systems, missile guidance, aircraft landing systems, etc. generally provide an angle sensing mechanism and a range sensing mechanism. These mechanisms determine the direction of the detected object in at least one and usually two planes, commonly referred to as azimuth and elevation, and the range of the object from the mechanism. In these object detection and location systems, the range and angular position of an object are extracted from the electromagnetic energy received from that object. One of the prior art systems employs quadrantally related radiating and receiving antenna elements which are disposed about an axis of symmetry, sometimes known as the boresight axis. Since the elements are quadrantally located about the boresight axis, an object which is positioned on the axis will excite all four elements equally. However, an object which is positioned off the boresight axis will cause amplitude and phase differences in the energy received by these quadrantally disposed elements. It is the comparison of these differences which yields angular position information about the object. Range of the object is in many cases determined by measuring the time lapse between the transmission of energy and the reception of that energy after having been reflected by the object.

In many prior art systems, the received energy which excites the quadrantally disposed antenna elements is directed through a comparator network which may consequently provide signals indicating angular postion and range of the object from the antenna system. The angular position signals frequently take the form of "azimuth error" and "elevation error" signals which are processed to show the distance that the object is positioned off the boresight axis. These error signals may be utilized in associated systems to provide desired visual indications of object detection and location, control functions and various other functions. An example of a common control function is the use of the error signals to control the position of the antenna apparatus so as to keep the antenna pointed at the detected object.

The quadrantally disposed elements are typically located so that they form opposite pairs about a central azimuth plane and opposite pairs about a central elevation plane, both of which planes intersect at the boresight axis to define the quadrants. The terms azimuth and elevation are used in accordance with their meanings as are well defined in the art; azimuth refers to angular position in a horizontal plane, and elevation refers to angular position in a vertical plane. However, the terms are relative and are primarily used in order to establish reference planes so as to make visualization of antenna operation somewhat easier.

In relation to quadrantally disposed antenna elements, the electromagnetic energy which is received from an object located on the boresight axis will have identical amplitude and phase characteristics for all four elements. It therefore follows that the energy received from an object which is on boresight in elevation but off boresight in azimuth will be greater in amplitude and will be leading in phase in the column of antenna elements closer to the object than in the further column of antenna elements. This is due to the physical properties of energy dissipation and phase variation over distance. Similarly, the energy received from an object which is on boresight in azimuth but high in elevation will be greater in amplitude and will be leading in phase in the row of antenna elements closer to the object than in the further row. Thus, it can be seen that the energy received from an object which is off boresight in both azimuth and elevation will be greater in amplitude and will be leading in phase in the antenna element closest to that object than in the remaining three elements.

To determine the location of a radiating object, the amplitude and phase excitation of all four antenna elements are compared. Typically in prior art systems, the energy inputs of all the antenna elements are applied to a comparator network. Basically a comparator network such as a waveguide comparator network, performs energy division, combination and other processing functions in response to energy applied at its four input terminals. The net result is typically the provision of three outputs; one of which represents an azimuth error signal, another of which represents an elevation error signal and the third of which represents a reference signal sometimes known as a sum signal. In many prior art systems, the comparator network derives the sum signal from the four input terminals. However, some systems exist in the prior art which use a fifth antenna element known as a sum antenna which is independent of the comparator network. In both of these cases however, a comparator network exists to generate azimuth error and elevation error signals.

The sum signal has two prevalent uses in prior art systems. The first use is to determine the range of a detected object. As discussed previously, the time relationship of the sum signal to the transmitted signal indicates the target range. The second use is as a reference signal. The absolute amplitude of the azimuth and elevation error signals are not properly representative of the off axis deviation of the object because different objects reflect electromagnetic energy differently and the signals necessarily decrease in strength with distance. Therefore, the azimuth and elevation signals may be separately combined with the sum signal to use the sum signal as a reference.

Previously, the comparator networks and other such systems used to derive the azimuth error, elevation error and sum signals have been complex and operationally limited. These systems have almost invariably invoked the use of devices such as waveguide hybrid networks, conventional tees, magic tees, folded magic tees, slot-couplers, high-speed switches, and various other waveguide devices. One of the primary objections to the prior art system described above has been to the extreme complexity of these comparator circuits and waveguide devices which were required to produce accurate error signals. Because the prior art system is extremely phase sensitive, the comparator network must be placed as close to the antenna elements as possible. Furthermore, the above mentioned waveguide devices make the comparator network relatively bulky which is a substantial disadvantage when the system is to be used in an airborne application.

A further difficulty with prior art systems lies in the balancing of the comparator networks. If these systems are not absolutely balanced between all four antenna paths, a change in frequency may result in an erroneous indication of the angle of the detected object due to a "boresight shift" problem. It is practically impossible to manufacture such hybrids and other devices mentioned above in such a way that they are electrically identical. Therefore, when used in a comparison network their operation will be different from each other as frequency is changed and so the "boresight shift" results.

Throughout the processing of input signals, compensation or adjustments must be available to preserve the phase relationship existing between the input signals since phase is critical to determine the angular position of an object. Any uncompensated phase delays added by hybrid networks or other devices in the circuit will distort the input information and result in decreased accuracy. Furthermore, every additional device which interfaces in the comparator system must be matched to decrease detrimental power reflections and device interactions. The above considerations have caused prior art systems to become very complex and bulky as can be seen by reference to U.S. Pat. No. 3,633,203 entitled "Antenna Lobing System" and assigned to the assignee of the present invention.

Certain prior art systems exist which solve some of the bulk and tuning problems discussed above. For instance, in U.S. Pat. No. 3,129,425 entitled "Three Beam Monopulse Radar System and Apparatus", an antenna apparatus consisting of only three antenna elements is disclosed. As the patent teaches, an unknown point to be located in space can be successfully located by three observation points and only three are needed. The elimination of the fourth antenna element results in the reduction of the amount of comparator network components by substantially 50 percent. This results in an antenna system which is less bulky and easier to balance than prior art systems consisting of four antenna elements. This is due to the fact that there are less devices involved. However, this patent teaches the use of phase shifters and couplers which are significant causes of boresight shift and physical bulk.

Another prior art system exists which would seem to solve the problems of using phase shifters and couplers. That system is taught in U.S. Pat. No. 3,037,204 entitled "Trimode Turnstile Monopulse Feed". This patent teaches the use of a "trimode turnstile junction" which replaces phase shifters, couplers, and other hybrid devices and instead requires only the connection of a "polarization resolver" to form the azimuth error and elevation error signals. This polarization resolver is typically a dual mode or orthogonal mode transducer which derives the azimuth error signal and elevation error signal from the trimode turnstile junction. The teaching in this patent would seem to greatly reduce the previously discussed phase shift and boresight shift problems since the only remaining source of substantial phase or balance errors lies in the phase relationships of the antenna elements themselves. However, it is well known to those skilled in the art that this source of error is significant and the adjustment and alignment of four antenna elements can be time consuming and only marginally satisfactory. Furthermore, the feed system taught in this patent has a sum signal which is generated from the four antenna elements. Since all four elements are used for object detection and location, the beamwidth of the sum is restricted to one-half the beam width that an independent sum antenna would have. Thus, even with the teaching of this patent, there remained significant disadvantages.

SUMMARY OF THE INVENTION

Accordingly, it is a purpose of this invention to provide a new and improved antenna system which overcomes most, if not all, of the above identified disadvantages of prior art antenna systems. The invention maintains the use of antenna elements disposed about an axis of symmetry or boresight axis; however, it is another purpose of the invention to provide an antenna system which is mechanically and electrically simple and which does not utilize hybrid junctions, phase shifters, couplers and similar devices and which substantially eliminates any boresight shift due to frequency changes.

It is another purpose of the invention to provide an antenna system which utilizes a comparator network of extreme electrical and mechanical simplicity and of minimized physical size.

It is another purpose of the invention to provide an improved antenna tracking system which is smaller, stronger, mechanically and electrically simpler, and more easily manufactured than prior art systems.

The above purposes and advantages are accomplished in accordance with the present invention by the combination of four receiving/radiating antenna elements, three of which are detection and tracking antennas located triangularly about an axis of symmetry or boresight axis. The fourth receiving/radiating antenna element is primarily an independent sum antenna and is preferably positioned on the boresight axis. The three tracking antennas are connected to a four-port waveguide turnstile-type junction which has the connections to the tracking antennas spaced at 120° intervals about its circumference. The circular fourth port of this turnstile junction is connected to an orthogonal mode transducer which conducts an azimuth error signal out one port and an elevation error signal out a second port. The signals output from these ports correspond to the angular magnitude that the object is off the boresight axis. By comparing the phase of these signals with the phase of the sum antenna output which may be located on the boresight axis, the direction sense of the object from the boresight axis is determined.

It can be seen that the azimuth and elevation planes still exist in this configuration and intersect in the center of the sum antenna. Thus, an object located on the boresight axis will excite the three tracking antennas equally. Likewise, the electromagnetic energy received from an object located on the center of the elevation plane, but off center in azimuth will be greater in amplitude and will be leading in phase in the closer antenna element than in the further antenna elements. Thus, an object which is off center in both azimuth and elevation planes will excite one element more in amplitude and will phase lead all the other elements unless the object is located on a line which bisects a side of a triangle drawn between the three tracking antennas. In that case, two elements will be equally excited; however, the third element and the sum element will be excited differently in amplitude and will differ in phase, and so a determination of the position of the object can still be made. As was discussed previously, only three observation points are required to locate the position of an unknown object in space.

The disposition of an independent sum antenna in the center of the triangle drawn between the tracking antennas provides an independent reference for deriving the sense direction of the azimuth and elevation signals as well as providing a means of determining range. Since the sum antenna is an independent antenna, i.e., the sum signal is not derived from the tracking antennas, then the beamwidth of the antenna system can be determined as a direct function of the size of the independent sum antenna. Furthermore, the use of an independent sum antenna permits a simpler construction of the antenna system since it is easier to maintain the input phase relationships between all four antenna elements throughout the circuitry. Altering the phase of the sum antenna by size variation, routing changes and other techniques well known in the art permits the maintenance of the input phase relationship between the sum antenna and the three tracking antennas throughout the signal processing circuitry of the invention.

All three tracking antennas are connected to a four port turnstile junction. The three ports to which the tracking antennas are connected, one to each port respectively, enter the turnstile junction at 120° intervals. This turnstile junction resembles the five port turnstile junction previously discussed and well known in the art with a circular waveguide cross section which functions as an input/output port. A difference exists in the invention in that there are only three symmetrical rectangular ports as compared to the typical four ports found in the prior art.

Since the junction has a circular waveguide cross section, it can be seen that an elliptical wave will be formed in the junction if the energy entering the three symmetrical ports is unequal in amplitude or phase. This energy will represent the "difference" in the signals in the three antenna elements. Thus, if the energy entering the turnstile through the three symmetrical ports is equal, as it would be if an object were located on the boresight axis, complete cancellation will occur in the junction and no energy will be conducted out the circular fourth input/output port to the orthogonal mode transducer.

The orthogonal mode transducer may be of any type well known in the art as long as it is capable of sensing and conducting two signals of orthogonal polarization planes, one each through a separate port. Preferably, the output ports of the transducer are oriented in a physical relationship with the three tracking antennas such that one output will represent azimuth error and the other output will represent elevation error. Then, by comparing the phase of these signals with that of the sum signal from the independent sum antenna, the direction and distance of the object off boresight may be determined.

Thus, the invention provides all the signals provided by prior art antenna systems but uses only an independent sum antenna with three tracking antennas connected to a turnstile junction and an orthogonal mode transducer. There is little difficulty in matching the electrical length of the sum antenna to the tracking antenna circuit since the tracking antenna circuit is relatively simple and proceeds along a substantially straight path. Furthermore, because of the small number of parts and connections, the invention is sturdier, more accurate, easier to align, and easier to construct than prior art systems.

The novel features which are believed to be characteristic of this invention, both as to its structure and method of operation, together with further objects and advantages thereof, will be better understood from the following descriptions considered in connecton with the accompanying drawings:

DETAILED DESCRIPTION OF THE INVENTION

Figure 1:
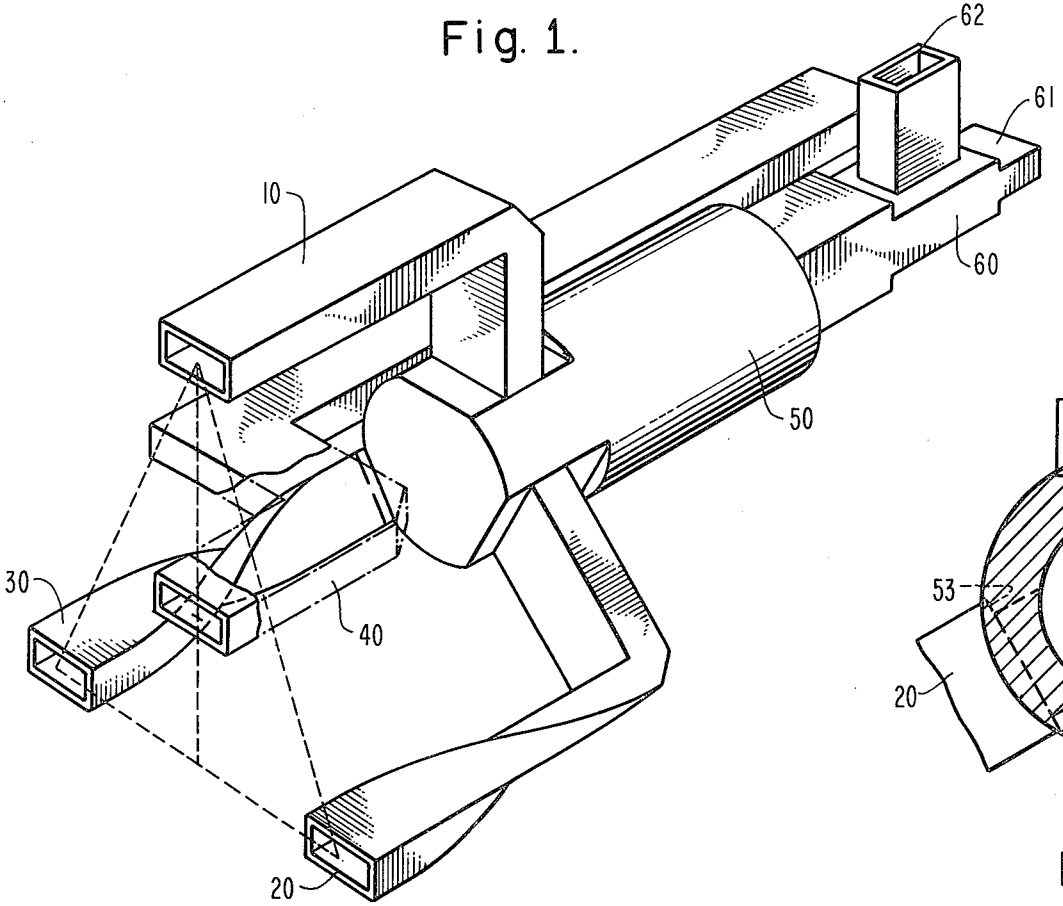
FIG. 1 is a perspective view of a four element antenna turnstile tracking system in accordance with the subject invention. Furthermore, it shows the placement of the three tracking antennas at the vertices of a triangle and the placement of the sum antenna at the center of that triangle.
Figure 2:
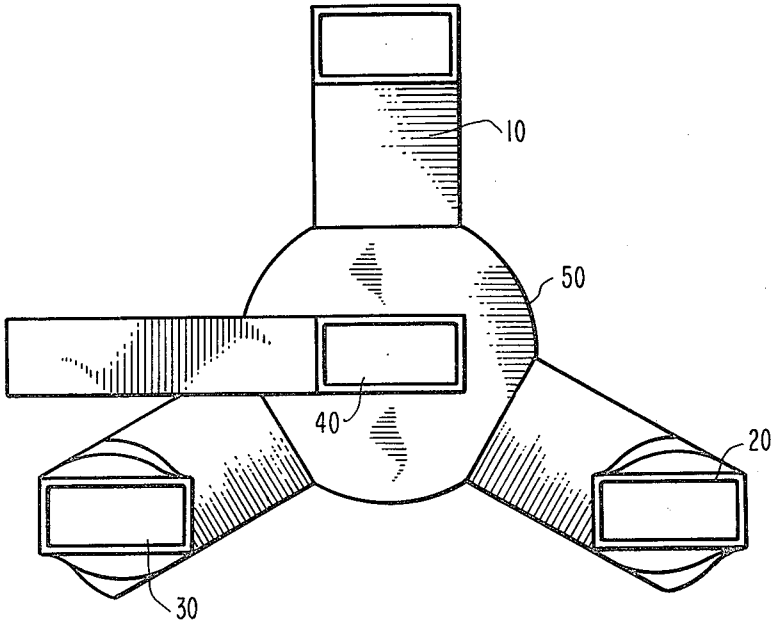
FIG. 2 is a front view of FIG. 1 and shows the relative placement of the three tracking antennas and the sum antenna.

In FIGS. 1 and 2 there is shown a four element antenna turnstile tracking system. The system depicted in these figures comprises three detection/location or tracking antennas, 10, 20 and 30, a sum antenna 40, a four port circular waveguide turnstile junction 50, and an orthogonal mode transducer 60. The three tracking antennas need not be of identical size or length; however, they must be of a size and length relationship so that equal energy entering all three antennas traverses them with identical phase and amplitude such that at the output ends which are connected to the turnstile junction 50, the phases and amplitudes are the same. This requirement would appear to indicate that there must be some type of phase compensation or adjustment to tracking antenna 10 since it does not have the twist in it as do antennas 20 and 30. The twisting of antennas 20 and 30 results in a longer electrical length in them than in antenna 10.

Tracking antennas 10, 20 and 30 are preferably located at the vertices of an equilateral triangle which may be drawn between their centers. This configuration is depicted in FIG. 1. As is shown, the vertices lie in the center of the antenna opening and all antennas are preferably identically oriented such that the E fields enter with the same orientation. That is, the broad dimensions of the antenna openings are parallel with each other and the narrow dimensions are parallel with each other. Sum antenna 40 is preferably positioned at the center of the equilateral triangle and is oriented identically with the tracking antennas 10, 20, and 30. It is then routed so as to not mechanically interfere with the connection of tracking antennas 10, 20 and 30 with turnstile junction 50. The sum antenna is preferably positioned in the center of the equilateral triangle which is the boresight axis as shown in FIG. 1 in order to establish the correct phase relationships. It is to be understood that equilateral triangular geometry is not a requirement. The three tracking antennas may be placed in any physical relationship with one another. There may be special applications where an isosceles triangle relationship is required, or a right triangle relationship. Furthermore, the independent sum antenna does not necessarily have to be located within the perimeter established by the three tracking antennas, although it can be located anywhere within that perimeter. The sum antenna may be located on the perimeter or outside it as needs require.

Tracking antennas 10, 20 and 30 are routed so that they connect to turnstile junction 50. The connection to turnstile junction 50 is made such that each respective tracking antenna connects at 120° intervals around the junction's circumference. Before connection to the turnstile 50, all three tracking antennas are constructed such that the E fields within them will be oriented identically in the same plane upon entry to the turnstile junction 50. As is shown in FIG. 1, tracking antennas 20 and 30 have been twisted by 120° and later bent at a right angle to orient the E fields properly upon input to turnstile junction 50. Tracking antenna 10 is constructed with only a right angle bend.

Figure 3:
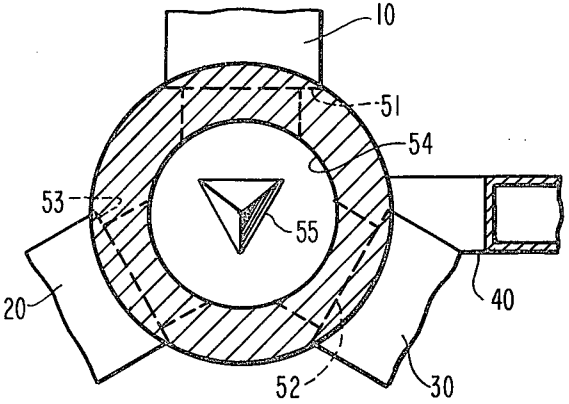
FIG. 3 is a rear view of the four port waveguide turnstile junction used in accordance with the invention.
Figure 4:
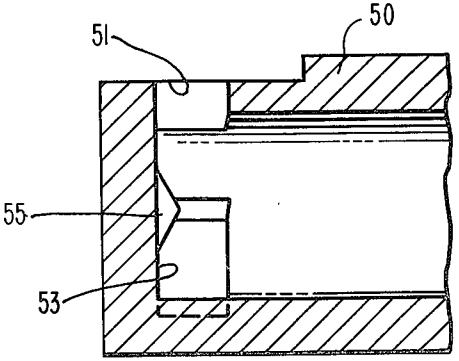
FIG. 4 is a side cross section view of FIG. 3.

Since the interior of the junction 50 is a circular waveguide 54, this connection at 120° angles inputs all three E fields through ports 51, 52 and 53 such that complete cancellation will occur if all are of equal amplitude and phase. An elliptical wave will be formed when input energy is not equal. FIGS. 3 and 4 depict the turnstile junction 50 as described above.

As is shown in FIGS. 3 and 4, object 55 is placed near the center of the turnstile junction 50. This object is used for matching the junction 50. Effective operation of the junction does not require that there be no reflected energy, however in the preferred application of the junction, it is desirable that reflected energy be eliminated. That is, the junction should be optimally matched in order to obtain maximum power transfer from the three input ports, 51, 52 and 53 to the output port 54 and vice versa. A pyramidal shaped object 55 is shown in FIGS. 3 and 4. This object achieves reactive effects in the junction, however this method of matching is well known in the art and its effects can also be accomplished by other arrangements well known in the art.

The output port 54 of turnstile juction 50 is connected to the input port of the orthogonal mode transducer 60. The transducer shown in FIG. 1 is a step function orthomode transducer, however any type of orthogonal mode transducer, other dual mode transducer or polarization resolver will suffice and these devices are well known in the art. In this application, the transducer is oriented such that its two output ports, 61 and 62, conduct desired components of the elliptical wave which was input from turnstile junction 50. In regard to the application of the invention shown in FIG. 1, the transducer will output the amplitude of the two axes of the elliptical wave generated in the turnstile junction 50. As is shown in FIG. 1, port 61 will conduct the horizontal component or azimuth-error signal while port 62 will conduct the vertical component or elevation-error signal. These signals may then be compared to the sum signal and processed by equipment well known in the art to determine the exact position of the detected object in relation to the invention.

There has been described and shown a new and useful four element turnstile tracking system which fulfills the aforementioned objects of the invention. The invention has been described and will be claimed in view of the typical embodiment which uses waveguide forms of the turnstile junction and orthogonal mode transducer. However, it is to be understood that the invention is sufficiently broad to include forms of components other than the waveguide form. Other forms of transmission lines are meant to be included in the claims and specification. Thus, for example, although referred to as "three symmetrical rectangular ports" in the turnstile junction, this description is meant to refer to these ports or components of the turnstle junction regardless of whatever form they may actually take. Likewise the description "four receiving/radiating antenna elements" may refer to well known horn apparatus, polyrods, dipoles and all equivalents.

What is claimed is:

1. An antenna system comprising:

(a) four antenna elements;

(b) a waveguide junction having a cylindrical waveguide main branch with three radially extending branches spaced at 120° intervals;

(c) means for connecting the first three antenna elements, one each to one each of the radial branches of the junction;

(d) the fourth antenna element being disposed in a preselected relationship to the first three elements; and (e) a polarization resolver connected to the cylindrical main branch of the junction, (f) whereby orthogonally related components of signals residing in the junction may be resolved.

2. The antenna system of claim 1 wherein the four antenna elements are waveguide horns.

3. The antenna system of claim 1 wherein the three radially extending branches of the junction are rectangular waveguides.

4. The antenna system of claim 1 or claim 3 wherein the first three antenna elements are disposed such that the center of each element lies on a different vertex of an equilateral triangle which may be drawn between the centers.

5. The antenna system of claim 4 wherein the fourth horn is disposed at the center of the equilateral triangle drawn between the centers of the first three horns.

6. The antenna system of claim 1 wherein means for connecting the first three antenna elements to respective ones of the radial branches of the junction includes polarization control means for maintaining a selected relationship between the polarization at each antenna element and each radial branch of the junction.

7. The antenna system of claim 1 further comprising:

a means for electrical transmission which has an electrical length equal to that of the electrical path through the connecting means, the junction, and the polarization resolver, the means for electrical transmission being coupled to the output port of the fourth antenna element.

8. The antenna system of claim 1 wherein the polarization resolver comprises an orthogonal mode transducer connected to the cylindrical main branch of the junction and aligned such that the transducer will output any azimuth error and elevation error signals which reside in the junction.

9. An antenna system comprising:

(a) three waveguide horns disposed in a single plane such that the centers of the three horns form the three vertices of an equilateral triangle which may be drawn through them;

(b) a fourth waveguide horn whose center is disposed on the center of the equilateral triangle which may be drawn through the centers of the first three horns;

(c) a waveguide junction of a cylindrical waveguide main branch with three radially extending rectangular waveguide branches spaced at 120° intervals;

(d) means for connecting each one of the first three waveguide horns to a different waveguide branch of the junction, said means including a polarization control means for maintaining a selected relationship between the polarization of energy at each horn and the polarization of energy at each rectangular waveguide branch of the junction;

(e) an orthogonal mode transducer connected to the cylindrical main branch of the junction and aligned such that the transducer will output an azimuth error and elevation error signal from the energy which resides in the junction; and (f) means for electrical transmission which has an electrical length equal to that of the electrical path through the connecting means, the junction, and the orthogonal mode transducer, the electrical transmission means being coupled to the output of the fourth horn;

(g) whereby the angular direction of an object which is in the antenna's field of view may be determined by comparing the amplitude and phase of the transducer outputs with the output of the electrical transmission means which is connected to the fourth horn.

* * * * *

UNITED STATES PATENT AND TRADEMARK OFFICE

CERTIFICATE OF CORRECTION

PATENT NO. : 4,460,898

DATED : July 17, 1984

INVENTOR(S) : ROBERT E. SILINSKY

It is certified that error appears in the above—identified patent and that said Letters Patent is hereby corrected as shown below:

In the front page of the patent, add to the References Cited, U.S. PATENT DOCUMENTS, the following:

| | | | |
|---|---|---|---|
| 2,751,586 | 6/1956 | Riblet | 343/16 |
| 2,805,415 | 9/1957 | Berkowitz | 343/777 |
| 3,037,204 | 5/1962 | Allen et al. | 343/100 |
| 3,129,425 | 4/1964 | Sanner | 343/16 |
| 3,173,145 | 3/1965 | Bowman | 343/777 |
| 3,324,475 | 6/1967 | Milne | 343/762 |
| 3,633,203 | 1/1972 | Kreinheder et al. | 343/16M |
| 4,243,991 | 1/1981 | Woodward | 343/777 |

Signed and Sealed this

Sixth Day of August 1985

[SEAL]

*Attest:*

DONALD J. QUIGG

*Attesting Officer* *Acting Commissioner of Patents and Trademarks*